US006749365B2

(12) United States Patent
Sina et al.

(10) Patent No.: US 6,749,365 B2
(45) Date of Patent: Jun. 15, 2004

(54) VIBRATION ISOLATION FOR A PERCUSSION RAMMER

(75) Inventors: Paul M. Sina, Jackson, WI (US); Gerard J. Fieweger, Kewaskum, WI (US)

(73) Assignee: M-B-W Inc., Slinger, WI (US)

( * ) Notice: Subject to any disclaimer, the term of this patent is extended or adjusted under 35 U.S.C. 154(b) by 18 days.

(21) Appl. No.: 10/100,310

(22) Filed: Mar. 18, 2002

(65) Prior Publication Data

US 2003/0175078 A1 Sep. 18, 2003

(51) Int. Cl.[7] ..... E01C 19/32
(52) U.S. Cl. ..... 404/133.1; 404/133.05
(58) Field of Search ..... 404/133.05, 133.1, 404/133.2

(56) References Cited

U.S. PATENT DOCUMENTS

| | | | | |
|---|---|---|---|---|
| 2,629,364 A | | 2/1953 | Anderson | |
| 2,630,784 A | | 3/1953 | Wallerstein, Jr. | |
| 2,942,589 A | | 6/1960 | Wacker | |
| 3,109,354 A | | 11/1963 | Van Kirk | |
| 3,232,188 A | | 2/1966 | Frohnauer | |
| 3,275,089 A | | 9/1966 | Kaiser et al. | |
| 3,372,759 A | | 3/1968 | Uebel | |
| 4,156,576 A | * | 5/1979 | Clavel et al. | 404/133.2 |
| 5,340,233 A | * | 8/1994 | Motl | 404/133.05 |
| 5,645,370 A | | 7/1997 | Zurbes et al. | |
| 5,733,071 A | | 3/1998 | Shudo | |
| 6,000,879 A | | 12/1999 | Greppmair | |
| 6,019,179 A | | 2/2000 | Zurbes | |
| 6,267,532 B1 | | 7/2001 | Persson | |
| 6,327,923 B1 | | 12/2001 | Greppmair | |

FOREIGN PATENT DOCUMENTS

| | | |
|---|---|---|
| FR | 715979 | 12/1931 |
| GB | 565783 | 11/1944 |
| GB | 1549771 | 8/1979 |

* cited by examiner

*Primary Examiner*—Robert E. Pezzuto
*Assistant Examiner*—Alexandra K. Pechhold
(74) *Attorney, Agent, or Firm*—Andrus, Sceales, Starke & Sawall

(57) ABSTRACT

A soil compacting percussion rammer includes an operator handle assembly that is isolated from the main machine frame by a shock absorbing mount oriented to absorb the horizontal components of operating movement of the rammer. In a preferred embodiment, the shock absorbing mount comprises a pair of torsionally resilient shock absorbers interconnecting the frame and the operator handle and oriented to position the shock absorbers on a common torsional axis that is vertically offset from and generally parallel to the horizontal operator handle.

5 Claims, 5 Drawing Sheets

VIBRATION ISOLATION FOR A PERCUSSION RAMMER

BACKGROUND OF THE INVENTION

The present invention pertains to percussive soil compacting tools and, more particularly, to vibration isolation in a manually operated percussion rammer.

Percussion rammers are well known in the construction industry and are used to compact soil and other loose materials in a variety of construction and excavation operations. Such devices are typically manually operated by a single operator. A percussion rammer is distinguishable from a vibration compaction device in terms of both amplitude and frequency of operation. A rammer may operate with a vertical amplitude in the range of 2–3 inches (about 50–75 mm) and a frequency of about 600–800 cpm. A vibratory compactor, on the other hand, has a much smaller amplitude, for example, 0.060 inch (about 1.5 mm) and a much higher frequency, for example, 4,000–6,000 cpm.

A typical percussion rammer thus provides a generally vertically oriented, large amplitude movement to a flat soil engaging shoe that compacts the soil with a pounding type of movement. The compacting shoe is typically mounted with its flat surface at an angle slightly less than 90° to the vertical and, as a result, the operating axis along which the percussive tamping movement is transmitted is slightly forwardly-inclined. The angle of operating movement may be, for example, 15° to the vertical. This angled orientation results in a forward component of motion with every stroke and permits the operator to guide the machine in a forward operating path over the surface by grasping a horizontal operator handle at the rear of the machine. The operator handle is typically attached to the rear of a frame that includes two generally horizontal laterally spaced components that are attached by their opposite forward ends to a cushioning pivot mechanism near the upper end of the operating axis. The cushioning pivot arrangement typically comprises a pair of large elastomeric elements interposed between the forward ends of the lateral frame members and the body of the machine, so the frame and operator handle may pivot vertically relative to the rammer as it moves up and down. This arrangement helps isolate the generally vertical component of operating movement from the operator handle and the hands of the operator grasping the handle. However, because of the inclined orientation of the operating axis of the machine, there is a significant horizontal component of movement that the torsional mounting of the side frame to the machine does little to damp or isolate. This horizontal component of movement is thus transmitted directly through the side frame members to the operator handle and the hands of the operator.

Recently, worker safety regulations worldwide have examined the effects of hand/arm vibration levels in manually operated vibratory equipment. Some jurisdictions have effected regulations that apply measured vibration levels to operating time to make sure that operators are given periodic rests while using such equipment. Of course, if vibration levels can be lessened or eliminated, operator time may be increased or the rest periods may be decreased. In any event, eliminating or lessening the horizontal component of percussion rammer operating movement would be a benefit to the machine operator.

SUMMARY OF THE INVENTION

In a basic embodiment of the present invention, an operator handle assembly is provided for a percussive soil compacting device to isolate generally horizontal components of operating movement from the hands of the operator, the assembly including a main frame attached at one end to the compacting device, and a manually engageable operator handle attached to the other end of the main frame with a shock absorbing mount oriented to absorb generally horizontal components of operating movement. In a presently preferred embodiment, the main frame includes a pair of laterally spaced frame members having ends adjacent the operator handle and the operator handle includes a generally horizontal manually engageable member having opposite lateral ends; the shock absorbing mount comprises a pair of torsionally resilient shock absorbers each of which is attached with a first connector to an end of said frame member and with a second connector to a lateral end of the operator handle, the first and second connectors oriented to position the shock absorbers on a common torsional axis that is vertically offset from and generally parallel to the horizontal member.

The shock absorbers preferably comprise elastomeric elements, each element being mounted between said first and second connectors. In a preferred embodiment, the elastomeric elements are generally cylindrical and are mounted with their axes on the common torsional axis. In a particularly preferred embodiment, the horizontal member of the operator handle is mounted above the torsional axis.

In the operator handle assembly of the present invention, one end of the main frame is attached to the compacting device with a shock absorbing arrangement that is oriented to absorb generally vertical components of operating movement in a known manner. In an alternate embodiment of the invention, the shock absorbing mount for the operator handle comprises a pair of linear shock absorbers, each of which interconnects an end of a horizontal frame member and an end of the horizontal operator handle member to dispose the linear shock absorbers in a generally horizontal orientation aligned with the horizontal components of operating movement.

The present invention also encompasses a method for isolating generally horizontal components of operating movement in a manually operated percussive soil tamping apparatus from the operator, comprising the steps of (1) providing a generally horizontal operating handle member with opposite lateral ends, (2) providing a frame with a pair of laterally spaced generally horizontal frame members having ends adjacent the lateral ends of the handle member, and (3) connecting the ends of the handle member to the ends of the frame member with shock absorbing devices oriented to absorb generally horizontal components of operating movement and to minimize transmission thereof to the handle member. In the preferred method, the shock absorbing devices comprise a pair of torsionally resilient shock absorbers, and the connecting step comprises the step of mounting said shock absorbers on a common torsional axis vertically offset from and parallel to the operating handle member.

DETAILED DESCRIPTION OF THE PREFERRED EMBODIMENTS

Figure 1:
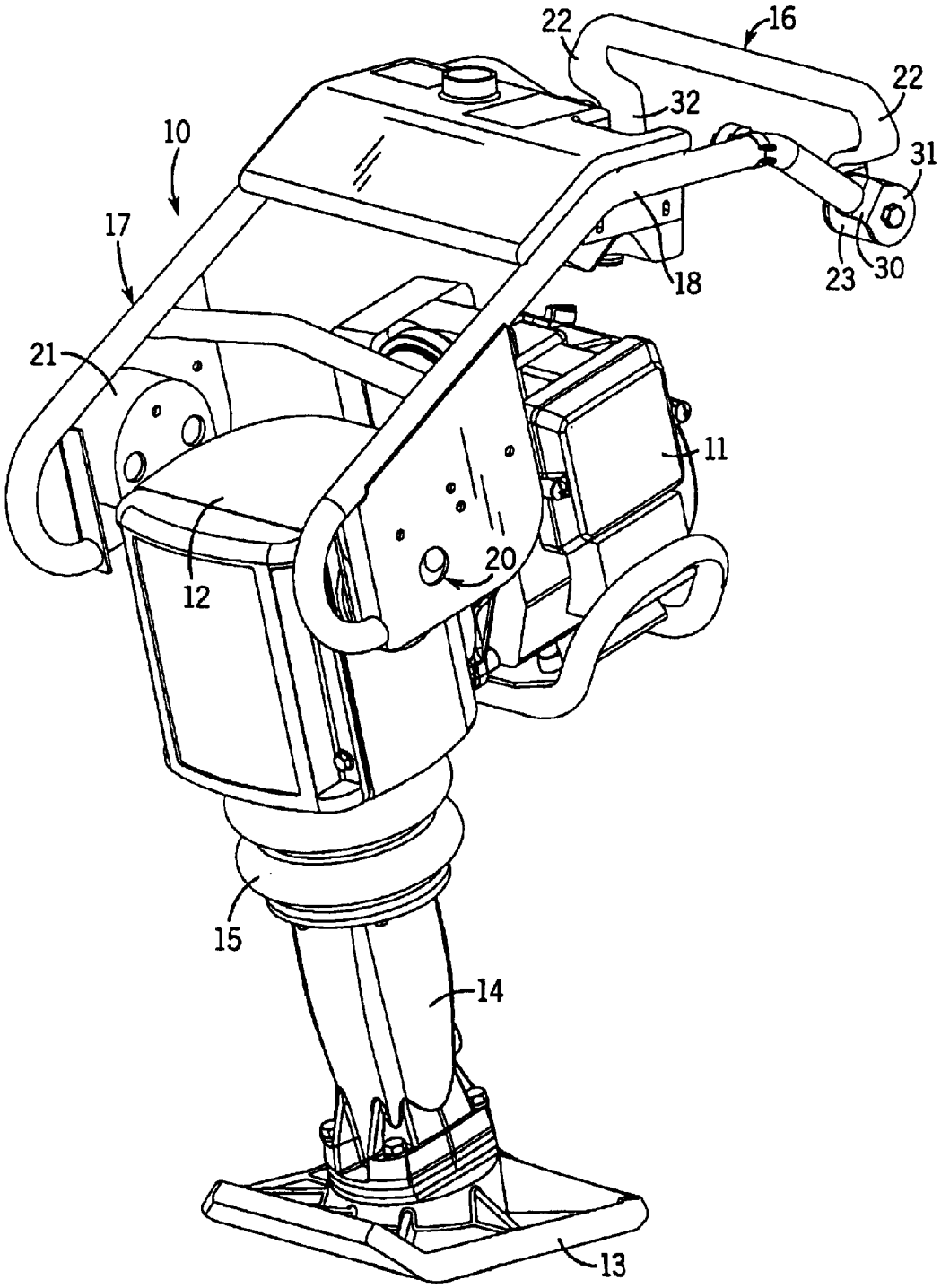
FIG. 1 is an isometric front view of a percussion rammer machine having an operator handle incorporating the subject invention.

A percussion rammer 10 includes a power source, such as a gasoline engine 11, mounted to the rear of a transmission housing 12 within which a transmission converts the rotary output of the engine into generally vertical reciprocating movement of a lower tamping plate or shoe 13. The transmission housing 12 and tamping shoe 13 are interconnected by a percussion housing 14 and a flexible elastomer bellows 15. A reciprocating piston and oppositely biased spring arrangement, within the percussion housing 14 and connected to the transmission, imparts a high amplitude, low frequency reciprocating tamping movement to the shoe 13 in a manner well known in the art.

The axis of operating movement A (FIG. 2) is inclined forwardly from the vertical in a known manner such that the rammer 10 will tend to move or jump forwardly with each upward stroke of the percussion piston, guided by an operator grasping a rearwardly mounted operator handle 16. The operator handle is connected to the machine by an upper frame 17 that includes a pair of laterally spaced side frame members 18 which are attached at their front ends to opposite sides of the transmission housing 12 with a pair of laterally aligned pivotal connections 20. Each pivotal connection 20 includes an elastomeric vibration isolator 21 providing damped torsional movement of the frame 17 with respect to the rammer 10. This arrangement limits the vertical movement transmitted to the hands of the operator on the operator handle 16. However, because of the angled orientation of the operating axis A, there is also a significant component of horizontal movement that is not damped or absorbed by the main vibration isolators 21 and is, therefore, transmitted directly to the operator handle 16 and the hands of the operator grasping the handle.

Figure 2:
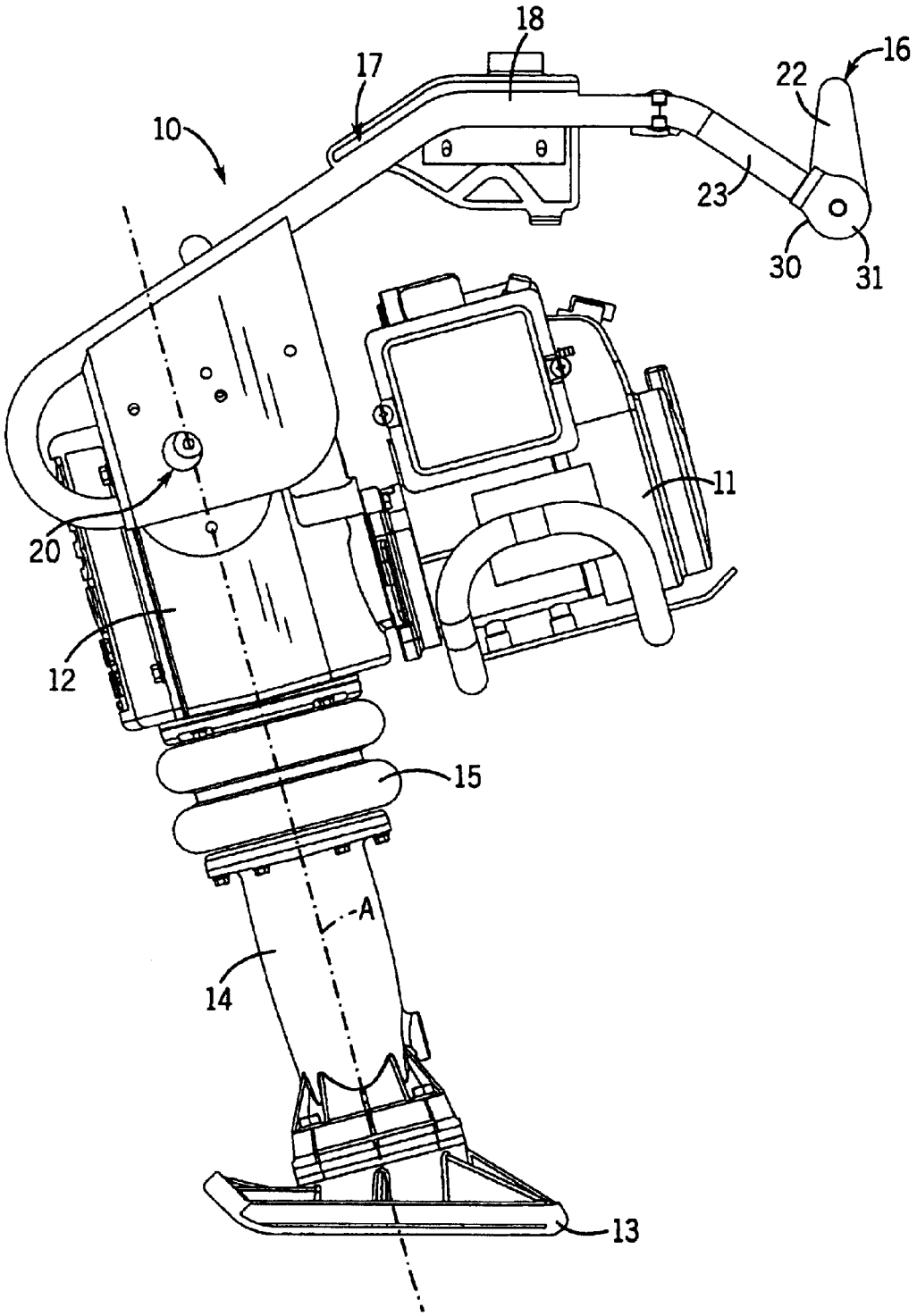
FIG. 2 is a side elevation view of the apparatus shown in FIG. 1.
Figure 3:
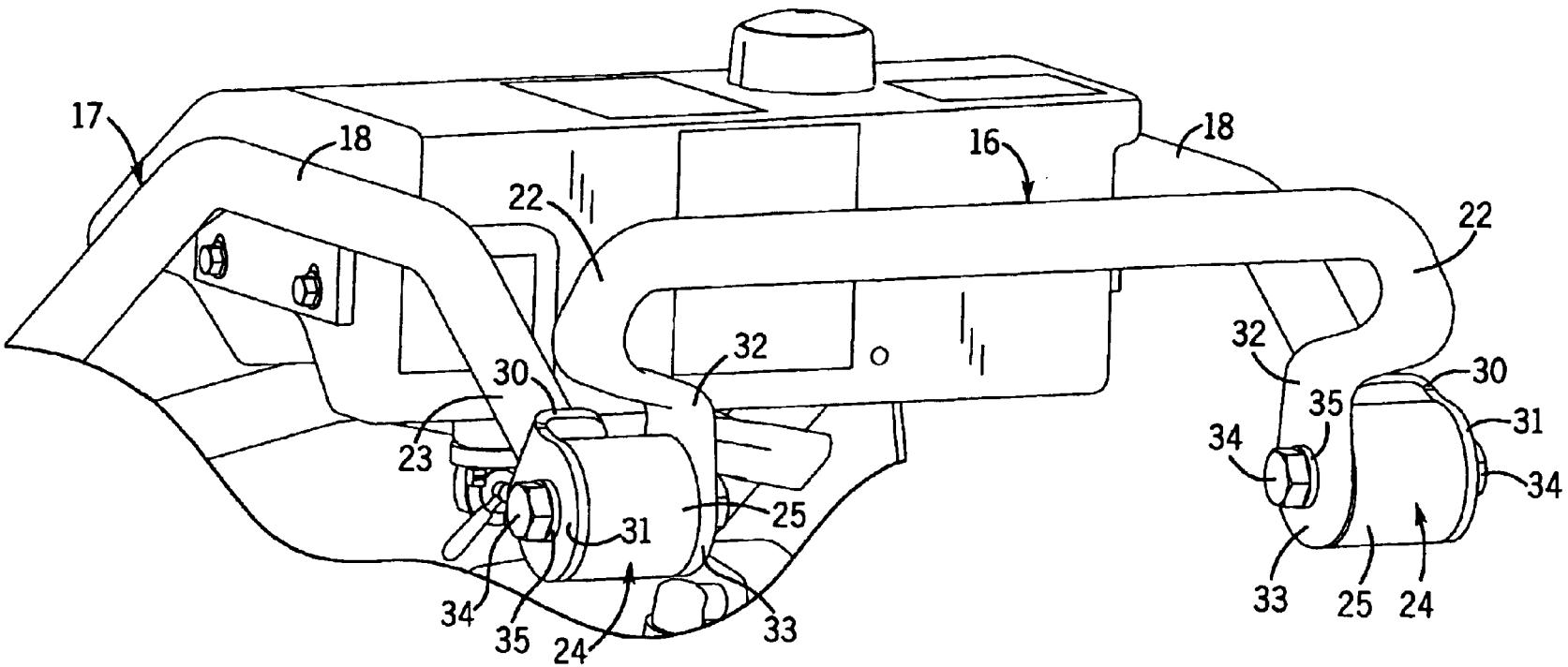
FIG. 3 is an enlarged isometric rear view of the upper portion of the machine shown in FIGS. 1 and 2.

In accordance with the present invention and the preferred embodiment thereof shown in FIGS. 1–3, the operator handle 16 is isolated from the main frame 17 with a vibration isolating and damping shock absorber arrangement. Specifically, the opposite lateral ends 22 of the horizontal operator handle 16 are connected to the rear ends 23 of the side frame members 18 with a pair of torsionally resilient shock absorbers 24. The shock absorbers 24 are mounted such that they lie on a common torsional axis T and the operator handle 16 is configured to be offset vertically from the torsional axis T.

Figure 4:
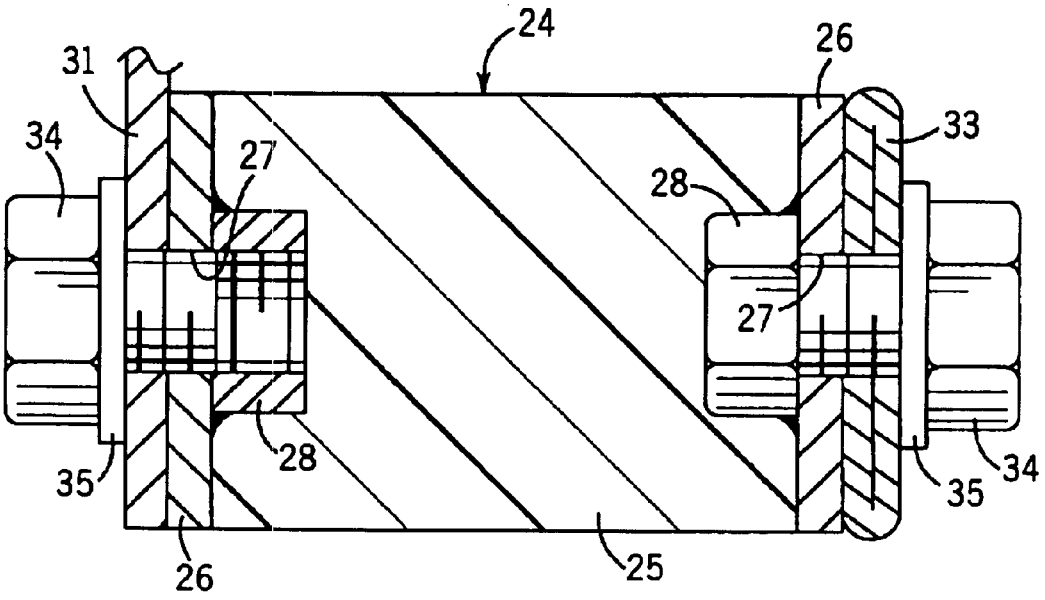
FIG. 4 is a sectional detail of the presently preferred shock absorbing element used with the present invention.

Referring also to FIG. 4, each of the torsional shock absorbers 24 may comprise a conventional elastomeric shock mount commonly used to isolate and damp vibrations in mechanical equipment. Each shock absorber 24 has a generally cylindrical body 25 to the opposite ends of which are attached circular end plates 26, each having a center hole 27 and carrying on its inside face a nut 28 aligned with the hole 27. The rear end of each side frame member 18 has attached to it an angled first connector 30, one leg of which comprises an apertured connector plate 31. The opposite lateral ends 22 of the operator handle 16 are each provided with an integral offset second connector 32 that includes an apertured connector face 33. Each shock absorber 24 is mounted between a connector plate 31 and a connector face 33 by means of a pair of bolts 34 and lock washers 35, the bolts threaded into the nuts 28 on the shock absorber end plates 26. The clamping force of the bolts secures the shock absorbers between the respective plate 31 and face 33 such that the only relative rotational movement between operator handle 16 and the frame members 18 is by torsional rotation of the shock absorbers on the torsional axis T.

The offset ends 32 of the operator handle 16 permits the handle to be mounted vertically above the torsional axis T, as shown, and as a result, generally horizontal components of operating movement of the rammer on its operating axis A are dampened and absorbed by the shock absorbers 24 and not transmitted directly to the hands of the operator.

The offset connector ends 32 of the operator handle 16 permits the handle to be mounted to the main frame members 18 in a variety of orientations or to be attached to modified frame members as well. The offset ends are configured to provide maximum lateral length to the operator handle 16, a feature that is particularly important in permitting the operator to place his hands at the extreme ends of the handle to maintain lateral stability of the rammer in operation.

Figure 6:
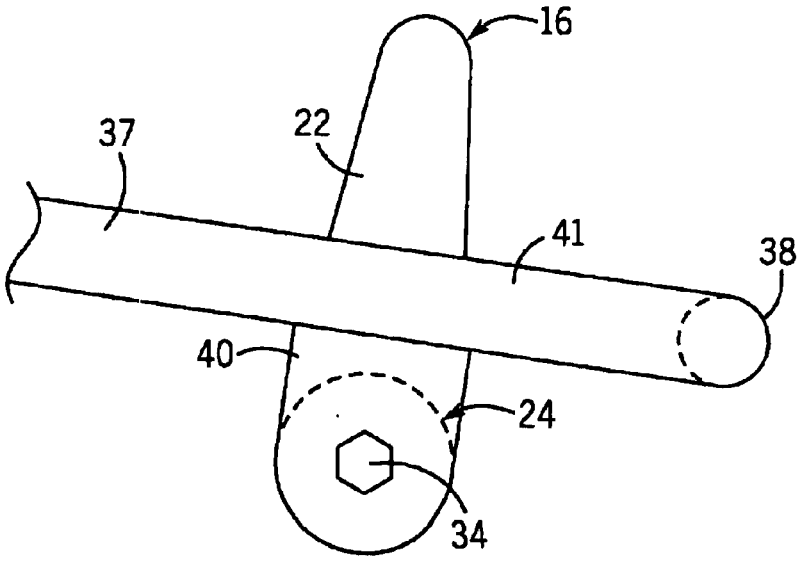
FIG. 6 is a side elevation detail of the operator handle of FIG. 5.
Figure 5:
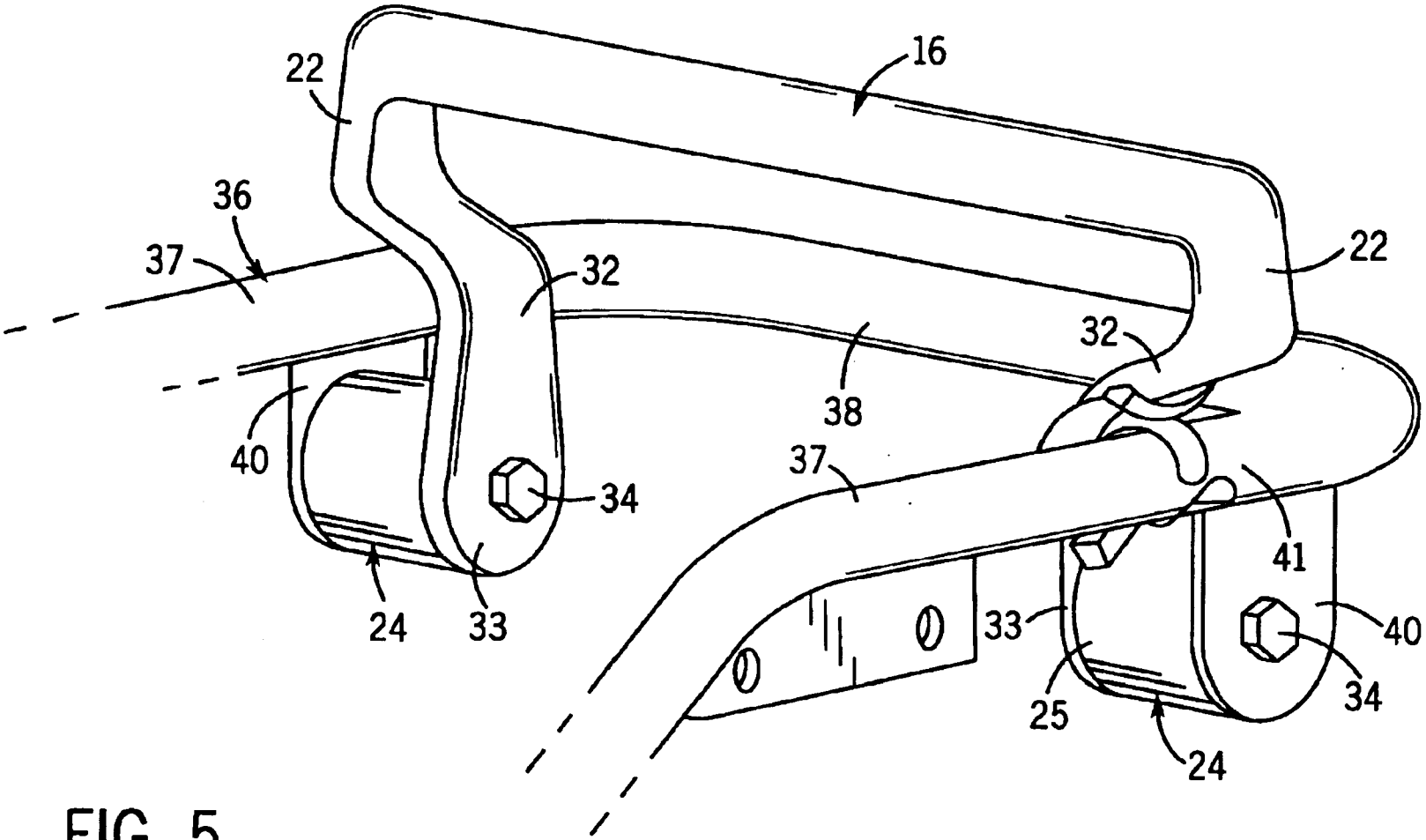
FIG. 5 is an isometric view of the rear portion of a percussion rammer frame and operator handle member showing a further embodiment of the invention.

In FIGS. 5 and 6, there is shown a modified frame 36 with which the operator handle 16 of the previously described embodiment may be used. In this embodiment, the ends of the side frame members 37 are generally horizontally disposed and are rigidly interconnected with a fixed primary operator handle 38. The shock absorbing operator handle 16 is attached as an auxiliary handle utilizing the same shock absorbers 24 previously described. The side frame members 37 are each provided with a downwardly depending apertured connector plate 40. These plates perform the same function as the connector plates 31 of the side frame members in the embodiment of FIGS. 1–3. Thus, the shock absorbers 24 are clamped between the connector plates 40 and connector faces 33 of the operator handle 16 using pairs of bolts 34 and lock washers 35.

The operator handle arrangement of FIGS. 5 and 6 positions the cushioned operator handle 16 at a convenient position for operator use during normal operation, but permits the operator to quickly move his hands to the rigidly mounted primary operating handle 38 if conditions of lateral instability or the like require a firmer control.

In lieu of the torsional elastomeric shock absorbers 24 described above, other types of shock absorbing devices could also be used to damp the transmission of horizontal operating movement to the isolated operator handle 16. For example, a torsion spring isolator should be applied in basically the same arrangement previously described, namely, with such torsion spring isolators mounted on a common torsional axis T. Also, a linear shock absorber arrangement could also be used. For example, referring to the FIG. 6 arrangement, linear shock absorbers could be placed to interconnect the tubular ends of the side frame members 37 and the aligned tubular ends 41 of an operator handle similar to fixed operator handle 38.

We claim:

1. An operator handle assembly for a percussive soil compacting device for isolating generally horizontal components of operating movement from the hands of the operator, said handle assembly comprising:

a main frame attached at one end to the compacting device said frame including a pair of laterally spaced frame members having ends adjacent the operator handle;

a manually engageable operator handle attached to the other end of the main frame with a shock absorbing mount oriented to absorb generally horizontal components of operating movement, said operator handle including a generally horizontal manually engageable member having lateral ends, said shock absorbing mount comprising a pair of torsionally and laterally resilient shock absorbers having solid elastomer bodies each of which is attached with a first connector to an end of said frame member and with a second connector to a lateral end of said operator handle, said first and second connectors oriented to position the shock absorbers on a common torsional axis vertically offset from and generally parallel to the horizontal member.

2. The apparatus as set forth in claim 1 wherein the elastomer bodies are generally cylindrical and are mounted with their axes on the common torsional axis.

3. The apparatus as set forth in claim 1 wherein the horizontal member of the operator handle is mounted above the torsional axis.

4. The apparatus as set forth in claim 1 wherein said one end of the main frame is attached to the compacting device with a shock absorbing arrangement oriented to absorb generally vertical components of operating movement.

5. In a manually operated percussive soil tamping apparatus of the type having a forwardly-inclined operating axis along which the percussive tamping movement is transmitted, an operator handle mounted to the rear of the apparatus by a generally horizontally extending frame, said frame having a forward frame end resiliently attached to the apparatus to isolate generally vertical components of operating movement from the operator and a rear frame end attached to the operator handle, a method for isolating generally horizontal components of operating movement from the operator comprising:

(1) providing a generally horizontal operating handle member having opposite lateral ends;

(2) providing the rear frame end with a pair of laterally spaced generally horizontal frame members having ends adjacent the handle member ends; and, (3) connecting the ends of the handle member to the ends of the frame member with a pair of torsionally and laterally resilient shock absorbers, and said connecting step comprises the step of mounting said shock absorbers on a common torsional axis vertically offset from and parallel to the operating handle member to absorb generally horizontal components of operating movement and to minimize transmission thereof to the handle member.

* * * * *